US011803149B2

(12) United States Patent
Koga

(10) Patent No.: US 11,803,149 B2
(45) Date of Patent: Oct. 31, 2023

(54) SHEET DETECTING DEVICE AND IMAGE FORMING APPARATUS

(71) Applicant: CANON KABUSHIKI KAISHA, Tokyo (JP)

(72) Inventor: Hiroto Koga, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/410,090

(22) Filed: Aug. 24, 2021

(65) Prior Publication Data

US 2022/0082971 A1 Mar. 17, 2022

(30) Foreign Application Priority Data

Sep. 15, 2020 (JP) ..... 2020-154855

(51) Int. Cl.
*G03G 15/00* (2006.01)

(52) U.S. Cl.
CPC ..... *G03G 15/50* (2013.01)

(58) Field of Classification Search
CPC ..... G03G 15/50; G03G 15/6502; G03G 15/6514; G03G 2215/00725; G03G 2215/00616; G03G 15/607; G03G 15/553; B65H 2553/41; B65H 43/06; B65H 43/08; B65H 2553/61
See application file for complete search history.

(56) References Cited

U.S. PATENT DOCUMENTS 6,298,214 B1 10/2001 Koga
6,823,154 B2 11/2004 Koga et al.
6,955,348 B2 10/2005 Koga
8,246,039 B2 8/2012 Koga et al.
8,511,674 B2 8/2013 Koga
8,564,239 B2 10/2013 Haruyama
9,452,902 B2 9/2016 Koga et al.
2005/0067757 A1 3/2005 Suga et al.
2008/0247774 A1 10/2008 Koga
2012/0027425 A1 2/2012 Haruyama
2012/0187620 A1* 7/2012 Kitamura ..... B65H 1/14 271/10.01

(Continued)

FOREIGN PATENT DOCUMENTS

JP 2012-025568 A 2/2012

*Primary Examiner* — Jennifer Bahls
*Assistant Examiner* — Quang X Nguyen
(74) *Attorney, Agent, or Firm* — Venable LLP

(57) ABSTRACT

A sheet detecting device includes a lever provided with a rotational shaft, a spring and a stopper. The lever is positioned in a stand-by position in a state of being in non-contacting with a sheet, and rotates about the rotational shaft from the stand-by position in a first rotational direction by being contacted with the sheet fed. The spring urges so as to rotate the lever in a second rotational direction opposite to the first rotational direction. The stopper restricts rotation of the lever beyond the stand-by position in the second rotational direction by being contacted with the lever after contacting of the sheet with the lever. A direction of a first force acting on the rotational shaft by the spring in a case in which the lever is positioned in the stand-by position is the substantially same direction as a direction of a second force which the lever receives from the stopper when the lever is in contact with the stopper by rotating in the second direction.

10 Claims, 9 Drawing Sheets

(56) References Cited

U.S. PATENT DOCUMENTS

| | | | | |
|---|---|---|---|---|
| 2015/0102551 | A1* | 4/2015 | Koga | B65H 7/06<br>271/110 |
| 2017/0108813 | A1 | 4/2017 | Sato et al. | |
| 2020/0207566 | A1* | 7/2020 | Tatematsu | B65H 7/02 |
| 2021/0087004 | A1 | 3/2021 | Koga et al. | |

* cited by examiner

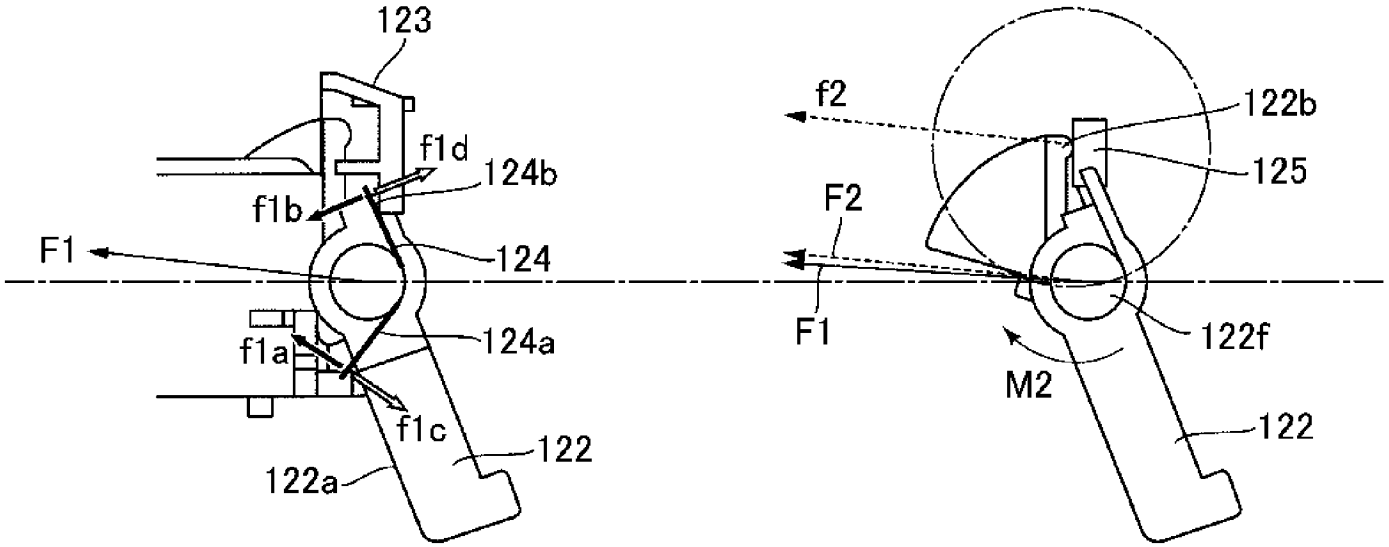
Fig. 5B
Fig. 5A
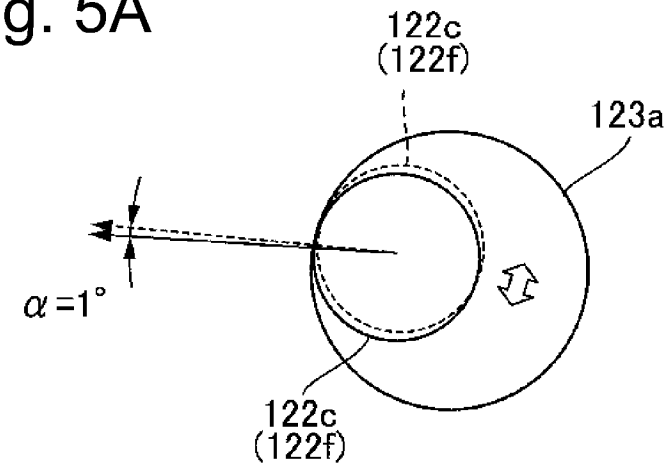
Fig. 5C

SHEET DETECTING DEVICE AND IMAGE FORMING APPARATUS

FIELD OF THE INVENTION AND RELATED ART

This invention relates to a sheet detecting device that detects sheets, and an image forming apparatus that forms images on sheets.

Conventional image forming apparatuses, such as copiers, printing machines, and FAX machines, use a sheet detecting device (media detecting device) that detects when a sheet of paper, such as printing paper used as a recording medium, has passed a predetermined position on the feed path and the timing thereof. Based on the detection results of the sheet detecting device, the image forming apparatus monitors the sheet feeding status in the apparatus, detects sheet feeding delays, double feed, jams, etc., and controls the image forming operation.

The sheet detecting device is known to be a combination of a rotatable member (also called a lever or flagging member) that rotates when it comes in contact with the sheet, and an optical sensor such as a photo interrupter that detects the rotation of the rotatable member.

The Japanese Laid-Open Patent Application No. 2012-25568 describes a media detection device having a sensor lever that rotates in contact with the tip of a recording medium being conveyed, an optical sensor that switches between a transmission state and a light-shielding state by rotation of the sensor lever, and a torsion spring to urge the sensor lever in a predetermined rotational direction.

According to the above document, when the recording medium passes through, the tip of the sheet contacts the sensor lever, which causes the sensor lever to move out of the stand-by position against the urging force of the torsion spring. After the recording medium passes, the sensor lever moves to the stand-by position due to the urging force of the torsion spring. The sensor lever is held in the stand-by position by a part of the sensor lever contacting the restricting member.

However, in the configuration described in the above document, the direction of force applied to the rotational shaft of the sensor lever when the sensor lever rotates differs greatly. Specifically, the direction of force applied to the rotational shaft of the sensor lever by the torsion spring due to the urging force of the torsion spring is opposite to the direction of force applied to the sensor lever by the restricting member when the sensor lever returns to the stand-by position.

The above two directions of force are largely dependent on the vibration caused by the play between the rotational shaft of the rotatable member and the bearing that supports the rotational shaft when the rotatable member returns to the stand-by position, and this is one of the reasons for the loud noise when the rotatable member returns.

SUMMARY OF THE INVENTION

The purpose of the present invention is to provide a sheet detecting device and an image forming apparatus capable of reducing the operating noise associated with sheet detection.

One embodiment of the present invention is a sheet detecting device comprising: a rotatable member provided with a rotational shaft, positioned in a stand-by position in a state of being in non-contacting with a sheet, and configured to rotate about said rotational shaft from the stand-by position in a first rotational direction by being contacted with the sheet fed; a detecting portion configured to detect a rotation of said rotatable member; a supporting member configured to rotatably support said rotational shaft; an urging member configured to urge so as to rotate said rotatable member in a second rotational direction opposite to the first rotational direction; and a restricting member configured to restrict rotation of said rotatable member beyond the stand-by position in the second rotational direction by being contacted with said rotatable member after contacting of the sheet with said rotatable member, wherein a direction of a first force acting on said rotational shaft by said urging member in a case in which said rotatable member is positioned in the stand-by position is the substantially same direction as a direction of a second force which said rotatable member receives from said restricting member when said rotatable member is in contact with said restricting member by rotating in the second direction.

Another embodiment of the present invention is a sheet detecting device comprising: a rotatable member provided with a rotational shaft, positioned in a stand-by position in a state of being in non-contacting with a sheet, and configured to rotate about said rotational shaft from the stand-by position in a first rotational direction by being contacted with the sheet fed; a detecting portion configured to detect a rotation of said rotatable member; a supporting member configured to rotatably support said rotational shaft; an urging member configured to urge so as to rotate said rotatable member in a second rotational direction opposite to the first rotational direction; and a restricting member configured to restrict rotation of said rotatable member beyond the stand-by position in the second rotational direction by being contacted with said rotatable member after contacting of the sheet with said rotatable member, wherein as viewed in a rotational axis direction of said rotatable member, an angle between a direction of a first force acting on said rotational shaft by said urging member in a case in which said rotatable member is positioned in the stand-by position and a direction of a second force which said rotatable member receives from said restricting member when said rotatable member is in contact with said restricting member by rotating in the second direction is 20 degrees or less.

Further features of the present invention will become apparent from the following description of exemplary embodiments (with reference to the attached drawings).

BRIEF DESCRIPTION OF THE DRAWINGS

FIG. 5A is a drawing illustrating the direction of force applied to the sensor lever for Embodiment 1, when the sensor lever is in stand-by position.

FIG. 5B is a drawing illustrating the direction of force applied to the sensor lever for Embodiment 1, when the sensor lever has reached the stand-by position from the operating position.

FIG. 5C is a drawing illustrating the direction of force applied to the sensor lever for Embodiment 1, especially around the rotational shaft of the sensor lever.

DESCRIPTION OF THE EMBODIMENTS

Embodiments of the invention are described below with reference to the drawings.

(Image Forming Apparatus)

Figure 9:
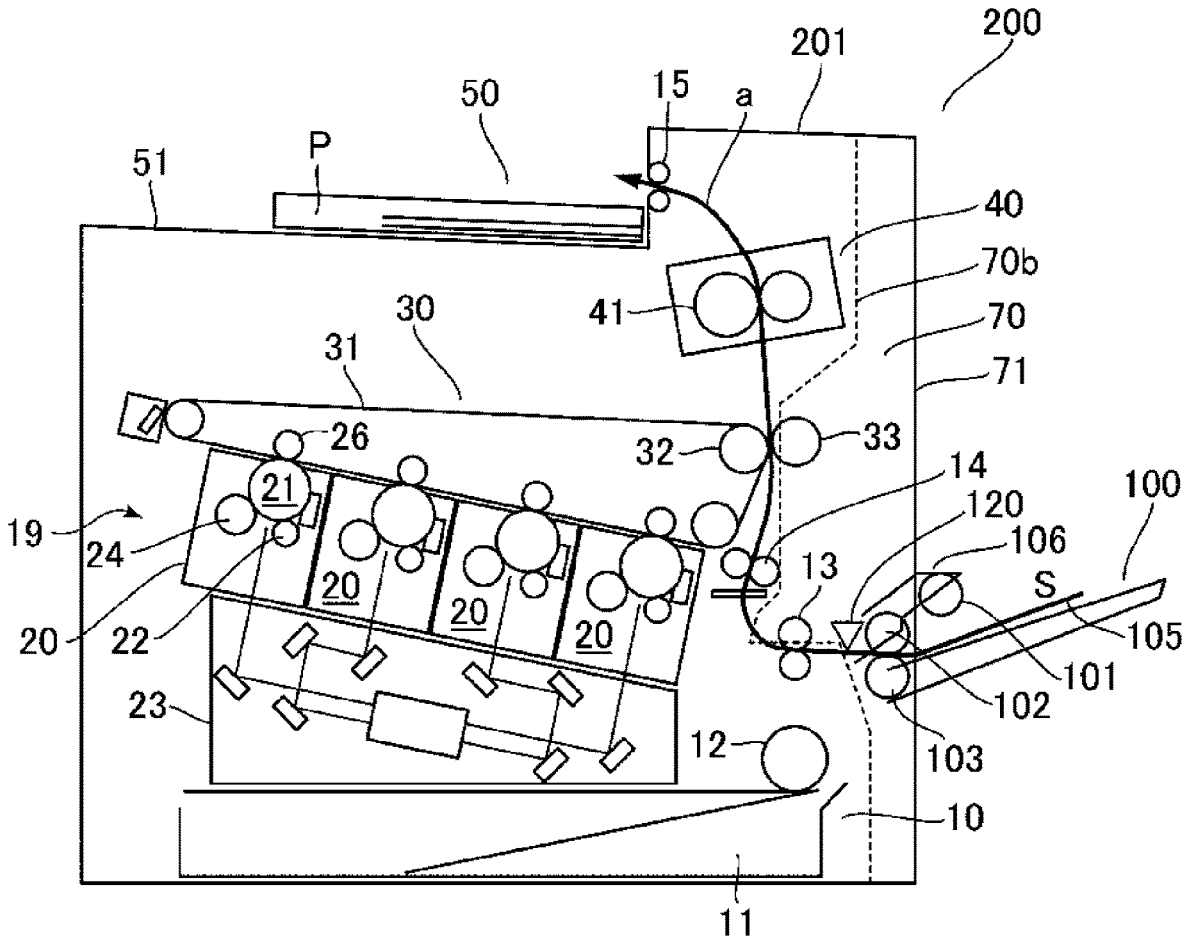
FIG. 9 is a schematic view of the image forming apparatus in the embodiments.

FIG. 9 shows a schematic view of the cross-sectional configuration of the image forming apparatus 200 in accordance with the present disclosure. The image forming apparatus 200 is an electrophotographic printer of the intermediate transfer method that forms (records) an image on a sheet S, which is a recording medium, based on image information input from an external device. A variety of sheets of different sizes and materials can be used as the recording medium, including paper such as plain paper and cardboard, plastic film, cloth, sheet materials with surface treatment such as coated paper, and specially shaped sheet materials such as envelopes and index paper.

The image forming apparatus 200 is equipped with an image forming portion 19, a fixing portion 40, a cassette feeding portion 10 and a multi-purpose feeding portion (also called a manual feeding portion) 100, and an ejecting portion 50. The image forming portion 19 has a tandem intermediate transfer system configuration including four process cartridges 20 that create toner images of yellow, magenta, cyan, and black colors, and an intermediate transfer unit 30. Each process cartridge 20 has a photosensitive drum 21 as an image carrier (electrophotographic photoreceptor), a charger 22, and a developer 24, and an exposure unit 23 is located below the four process cartridges 20. When the image forming apparatus 200 performs an image forming operation, the photosensitive drum 21 rotates and the charger 22 charges the surface of the photosensitive drum 21 uniformly. The exposure unit 23 exposes the photosensitive drum 21 with light modulated based on the image information, and writes an electrostatic latent image on the surface of the photosensitive drum 21. The developer 24 develops the electrostatic latent image carried on the photosensitive drum 21 into a toner image using a developer containing charged toner.

The intermediate transfer unit 30 has an intermediate transfer belt 31 as an intermediate transfer body. The toner image of each color formed on the photosensitive drum 21 in each process cartridge 20 is primary transferred to the intermediate transfer belt 31 by the primary transfer roller 26 facing the photosensitive drum 21 across the intermediate transfer belt 31. At this time, the toner images of each color are multiply transferred so that they overlap each other, forming a full-color image on the surface of the intermediate transfer belt 31. The full-color image carried on the intermediate transfer belt 31 is transferred to the secondary transfer portion by the rotation of the intermediate transfer belt 31. The secondary transfer portion is a nip portion formed between a secondary transfer roller 33 in contact with the outer periphery of the intermediate transfer belt 31 and an opposing roller 32 facing the secondary transfer roller 33 across the intermediate transfer belt 31.

In parallel with the image forming process described above, sheets S are fed one by one from the cassette feeding portion 10 or the multi-purpose feeding portion 100. The transfer path a in FIG. 9 shows an example of the path of a sheet S fed from the multi-purpose feeding portion 100 until it is discharged after image formation.

The multi-purpose feeding portion 100 feeds the sheets S set in the tray 105 as the sheet support section, one sheet at a time. That is, after the sheet S is fed from the tray 105 by the pickup roller 101, it is separated into only one sheet by the feed roller 102 and the separation roller 103, and is fed further downstream through the sheet sensor section 120. The configuration of the sheet sensor section 120 will be described in detail later. The sheet S is then fed via the transport roller pair 13 to the registration roller pair 14.

The tip of the sheet S is pressed against the nip portion of the registration roller pair 14 in the stationary state. Then, the feeding roller pair 13 further upstream pushes the sheet S to form a flexure (hereinafter referred to as a loop) in the sheet S between the registration roller pair 14 and the feeding roller pair 13. As the loop of the sheet S is formed, the skew of the sheet S is corrected so that the tip of the sheet S is aligned with the nip portion. Thereafter, the registration roller pair 14 feeds the sheet S at a timing synchronized with the image forming process by the image forming portion 19.

The image formed on the intermediate transfer belt 31 in the image forming portion 19 is transferred in the secondary transfer portion to the sheet S that has been fed to the secondary transfer portion by the registration roller pair 14. The sheet S that has passed through the secondary transfer portion is sent to the fixing portion 40. The fixing portion 40 has a fixing roller 41, a pressure roller that presses against the fixing roller 41, and heating means (e.g., a halogen lamp) that heats the image on the sheet S via the fixing roller 41, and heats and pressurizes the image while transporting the sheet S. This causes the toner to melt and then stick, resulting in an image that is fixed on the sheet S. The sheet S that has passed through the fixing portion is fed to the ejecting portion 50, discharged from the main body 201 by the discharging roller pair 15, and loaded on the stacking platform 51 provided at the top of the main assembly 201.

In the case of feeding sheets from the cassette feeding portion 10, the sheets stored in the cassette 11 are fed one by one by the feeding roller 12 and further conveyed by the feeding roller pair 13. Thereafter, after image formation in the same process as the sheet S fed from the multi-purpose feeding portion, the sheet is discharged from the main assembly 201 and loaded on the stacking platform 51.

The right-side portion of the image forming apparatus 200 in FIG. 9 is configured as a cover unit 70 that can be opened and closed with respect to the main assembly 201. The cover unit 70 can be separated from the main assembly 201 at the boundary 70*b* indicated by the dotted line by means of a hinge or other open/close configuration. This allows at least a part of the feeding path that constitutes the feed path a to be opened, so that sheets jammed inside the image forming apparatus 200 can be easily processed.

In the above explanation, the image forming portion 19 is an example of an image forming portion. An electrophotographic unit of the direct transfer method or an image forming unit of the inkjet or offset printing method may be used.

(Sheet Feeding Device)

Figure 1:
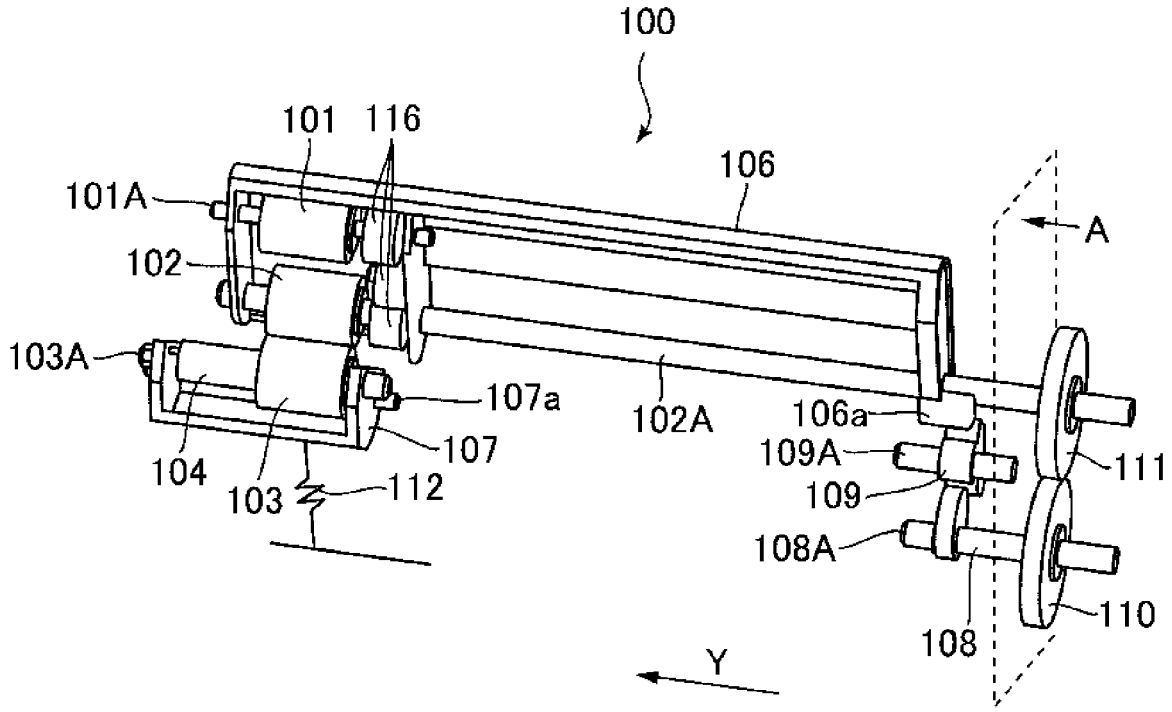
FIG. 1 is a perspective view of the sheet feeding device for Embodiment 1.
Figure 2:
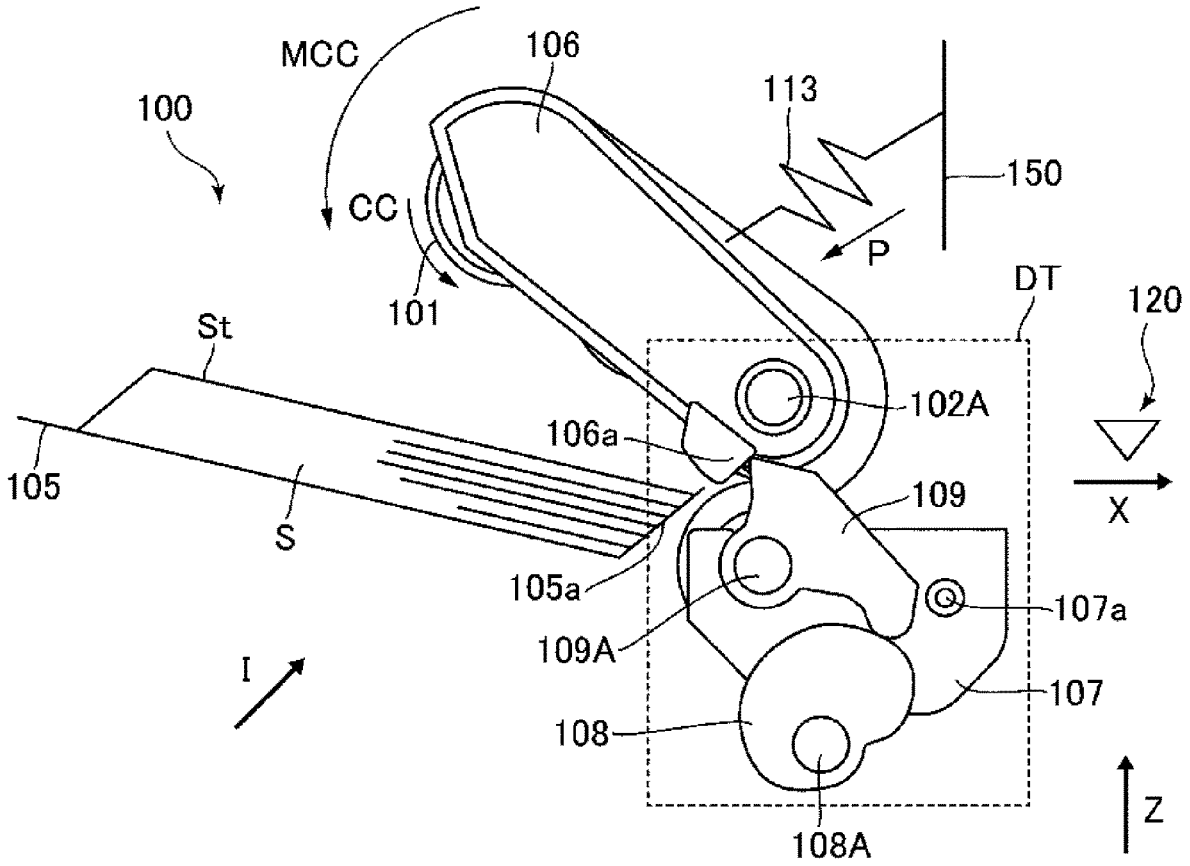
FIG. 2 is a schematic view showing the cross-sectional configuration of the sheet feeding device for Embodiment 1.

As an example of a sheet feeding device to which the sheet sensor portion 120 of this embodiment can be applied, the configuration of the multi-purpose feeding portion 100 is described using FIG. 1 and FIG. 2. FIG. 1 is a perspective view of the multi-purpose feeding portion 100, and FIG. 2 is a cross-sectional view of the section represented by arrow A in FIG. 1. FIG. 1 is a perspective view of the multi-purpose feeding portion 100 without the tray 105, viewed from the lower side (see arrow I in FIG. 2).

As shown in FIG. 1 and FIG. 2, the multi-purpose feeding portion is equipped with a pickup roller 101, a feeding roller 102, a separation roller 103, an elevating plate 106, a roller holder 107, a torque limiter 104, a tray 105, etc. The pickup roller 101 is rotatably supported by the roller shaft 101A, which is held by the elevating plate 106. The elevating plate 106 is pivotable in an roughly vertical direction around the roller shaft 102A that supports the feeding roller 102, and is urged downward by the urging force P of the pressure spring 113 that is supported by the frame 150. The elevating plate 106 is provided with a drive gear train 116, and the rotation input to the roller shaft 102A is transmitted to the pickup roller 101 via the drive gear train 116.

The separation roller 103 is supported on the roller shaft 103A fixed to the roller holder 107 via the torque limiter 104. The roller holder 107 is rotatably supported against the frame of the image forming apparatus around the shaft 107A, and is urged upward by the pressure spring 112. As a result, the separation roller 103 contacts the feed roller 102 with a predetermined nipping pressure and forms a nip portion (separation nip) between the feeding roller 102 and the separation roller 103.

The direction in which the sheet S is fed by the feeding roller 102 is hereinafter referred to as feeding direction X. The direction perpendicular to the feeding direction X (the direction of the rotational axis parallel to each other of the pickup roller 101, feeding roller 102, and separation roller 103) is referred to as the sheet width direction Y. The direction perpendicular to the feeding direction and the sheet width direction (the direction perpendicular to the feed path of the sheet S near the downstream side of the separation nip) is defined as the direction Z.

The roller shaft 102A of the feeding roller 102 extends in the sheet width direction Y. The feeding roller 102 is attached to one end portion and the feeding gear 111 is attached to the other end portion (FIG. 1). The feeding gear 111 is connected to a motor as a drive source installed inside the image forming apparatus, and rotates by the drive power transmitted from the motor.

The elevating plate 106 also extends in the sheet width direction Y, and an end portion opposite to the pickup roller 101 and the feed roller 102 in the sheet width direction Y is provided with a pressurized portion 106A that is pressed by the cam mechanism DT. The cam mechanism DT includes a cam 108 and a cam drive gear 110 mounted on a cam shaft 108A, and an arm 109 mounted on an arm shaft 109A. The cam drive gear 110 meshes with the feed gear 111 and rotates in unison with the cam 108. The arm 109 is capable of periodically pressing the pressurized portion 106A of the elevating plate 106 by the rotation of the cam 108, swinging the elevating plate 106 upward against the urging force of the pressure spring 113, and raising the pickup roller 101. When the arm 109 is not pressing the pressure portion 106*a*, the elevating plate 106 takes the position where the pickup roller 101 contacts the topmost sheet St on the tray 105 according to the urging force of the pressure spring 113.

When the sheet feeding operation is executed, the feeding gear 111 is rotated by the drive power supplied from the motor. Then, the rotation of the roller shaft 102A causes the pickup roller 101 and the feeding roller 102 to start rotating in the rotational direction (counterclockwise direction CC in FIG. 2) that feeds the sheet Sin the feeding direction. When the arm 109 is released from the pressurized portion 106*a* by the rotation of the cam 108, the moment MCC in the counterclockwise direction in the figure, which acts on the elevating plate 106 by the urging force of the pressure spring 113, causes the elevating plate 106 to rotate. This causes the pickup roller 101 to contact the topmost sheet St and feed it toward the feeding roller 102.

The topmost sheet St is guided by the guide 105*a* provided at the downstream end of the tray 105 in the feeding direction X, and reaches the separation nip. When multiple sheets S enter the separation nip, the topmost sheet St is transported to the feeding direction X by the feed roller 102, while the other sheets are prevented from moving to the feeding direction X by the frictional force received from the separation roller 103. In other words, the torque value of the torque limiter 104 is set to be large enough to overcome the frictional force between the overlapping sheets and regulate the rotation of the separation roller 103. On the other hand, when only the topmost sheet St enters the separation nip, the force received by the separation roller 103 from the topmost sheet St causes the torque limiter 104 to slip, and the separation roller 103 rotates following the feed roller 102. The topmost sheet St that has passed through the separation nip is further fed by the feeding roller pair 13 (FIG. 9), which is installed downstream of the feeding direction X.

After the tip of the topmost sheet St (the downstream end of the feeding direction X) reaches the separation nip, the arm 109 presses the pressure portion 106*a* of the elevating plate 106 again, causing the elevating plate 106 to swing upward and the pickup roller 101 to separate from the sheet S. This prevents the sheet S below the topmost sheet St from being fed continuously.

Then, the above operation is repeated by the repetition of the lifting and lowering operation of the elevating plate 106 by the rotation of the feeding gear 111, and the sheets S set in the tray 105 are fed while being separated one by one.

The separation roller 103 described above is an example of a separation member for separating sheets. A retard roller that is input with a driving force in a direction opposite to the rotation of the feeding roller 102 via a torque limiter may be used, or a pad-like friction member may be used. The feeding means for feeding the sheet is not limited to the pickup roller 101 and the feeding roller 102. For example, the sheet may be adsorbed and fed to a belt that rotates by air suction.

By the way, as shown in FIG. 2, a sheet sensor portion 120 is installed downstream of the separation nip in the feeding direction X as a detection mechanism to detect the sheet being fed from the multi-purpose feeding portion 100. The sheet sensor portion 120 has a sensor lever that rotates in contact with the sheet passing through the feeding path, and is configured so that the detection signal changes according to the position of the sensor lever. Based on the detection signal of the sheet sensor portion 120, it is possible to determine whether the sheet has been fed normally from the multi-purpose feeding portion 100, the timing at which the leading and trailing edges of the sheet have passed, etc., and to control the operation of the image forming apparatus appropriately. A detailed example of the sheet sensor unit 120 is described below.

Embodiment 1

Figure 3:
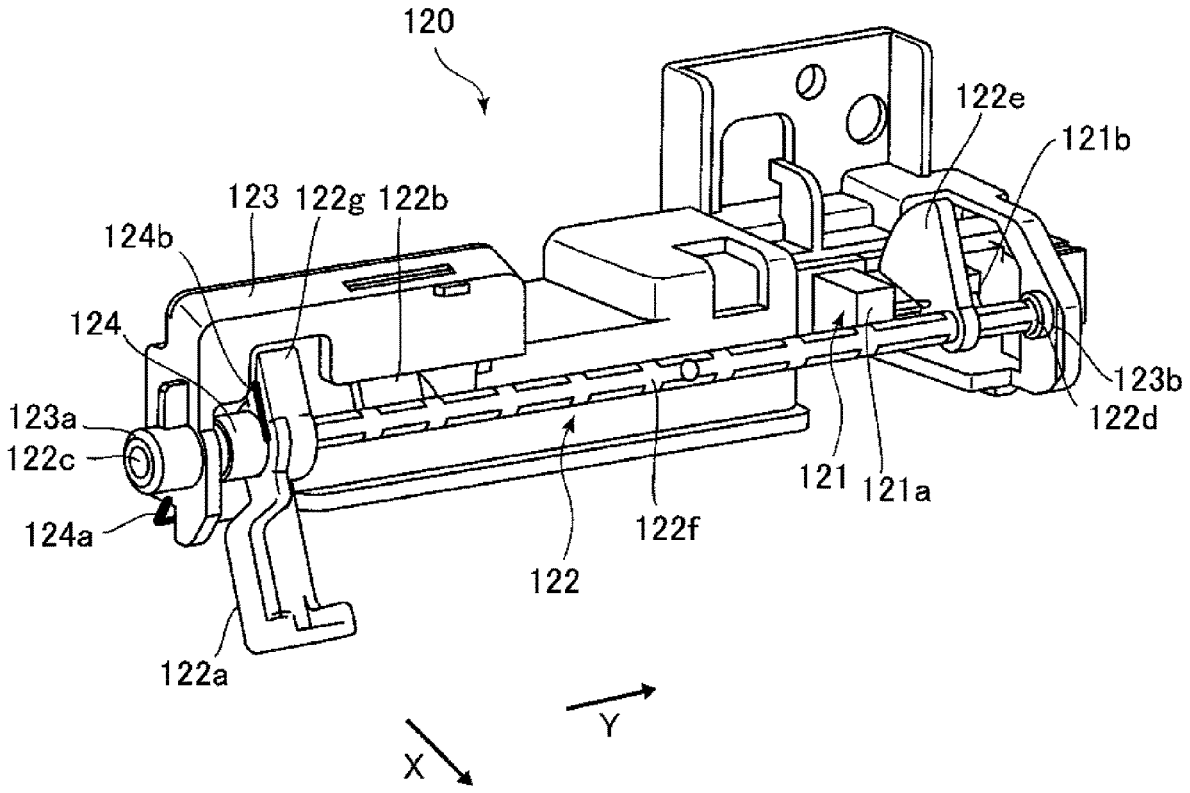
FIG. 3 is a perspective view of the sheet sensor portion for Embodiment 1.
Figure 4B:
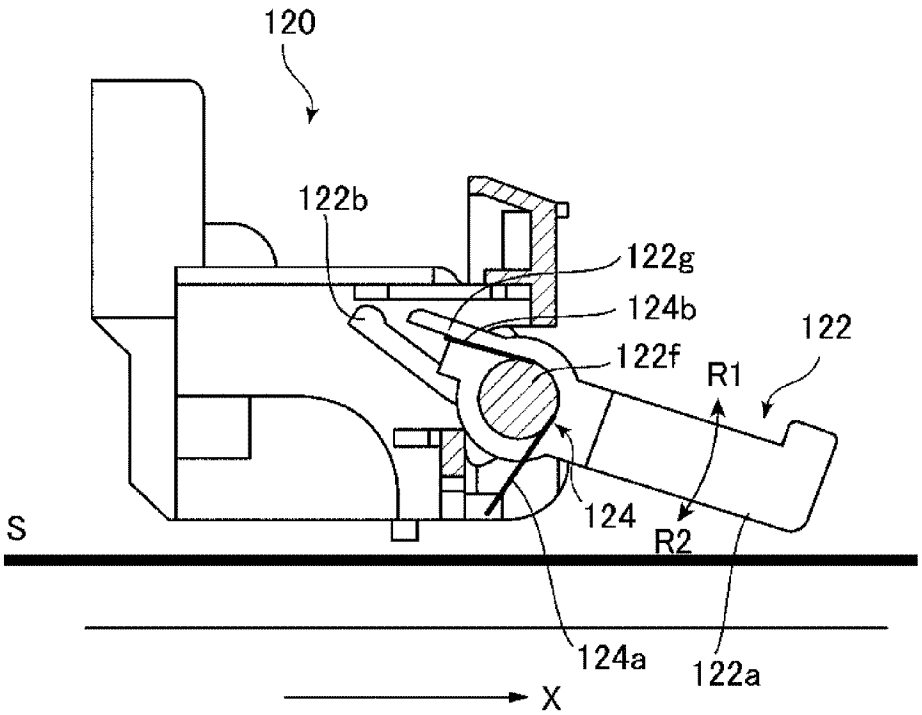
FIG. 4B is a drawing showing the operation of the sensor lever for Embodiment 1, with the sensor lever in the operating position.
Figure 4A:
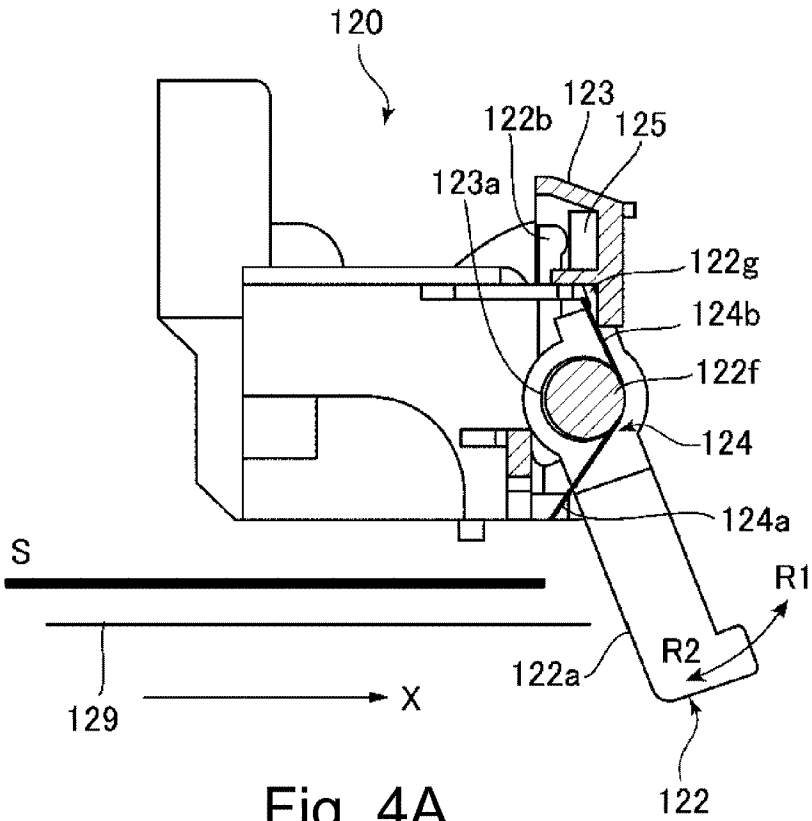
FIG. 4A is a drawing showing the operation of the sensor lever for Embodiment 1, with the sensor lever in the stand-by position.

FIG. 3 and FIGS. 4A and 4B illustrate the sheet sensor portion 120 for Embodiment 1. FIG. 3 shows a perspective view of the overall configuration of the sheet sensor portion 120. FIG. 4A and FIG. 4B are cross-sectional drawings of the sheet sensor portion 120 in the cross section perpendicular to the sheet width direction Y, and show the configuration near the sheet contacting portion 122*a* and the return spring 124.

The sheet sensor portion is equipped with a sensor 121, a sensor lever 122, a supporting member 123, a return spring 124, and a stopper 125, as shown in FIG. 3. The sensor lever 122 is the rotatable member of the present embodiment, and the sensor 121 is the sensing portion of the present embodiment that detects the rotation of the rotatable member. The stopper 125 is the restricting member of the present embodiment, which regulates the position of the rotatable member, and the return spring 124 is the urging member of the present embodiment, which urges the rotatable member.

In the present embodiment, each member is supported by a supporting member 123 as a holder, and sensor portion 120 is configured as a unit that can be installed together by fixing the supporting member 123 to the frame of the image forming apparatus. However, it is not limited to such a unitized configuration, and the sensor lever 122 and sensor 121 may be mounted individually.

The sensor 121 is a photointerrupter (also called an optical sensor) having a light-emitting element 121*a* that emits light and a light-receiving element 121*b* that faces the light-emitting element 121*a* in the sheet width direction Y and receives light from the light-emitting element 121*a*. The signal (e.g., voltage) emitted by the light-receiving portion 121*b* varies according to the amount of light incident on the light-receiving portion 121*b*.

The sensor lever 122 has a rotational shaft 122*f* extending in the sheet width direction Y, a sheet contacting portion 122*a*, a stopper contacting portion 122*b*, and a sensor light shielding portion 122*e*, each of which protrude from the rotational shaft 122*f* in a direction intersecting and perpendicular to the sheet width direction Y. One end portion 122*c* (one end portion) and the other end portion 122*d* (other end portion) of the rotational shaft 122*f* are rotatably engaged with bearing member 123*a* (first bearing member) and bearing member 123*b* (second bearing member) of the supporting member 123, respectively. In other words, the sensor lever 122 is supported by the supporting member 123 in a rotatable state with the center of the rotational shaft 122*f* as the rotational axis. In addition, the direction of the rotational axis of the sensor lever 122 in this embodiment is the same as the sheet width direction Y.

A slight play (e.g., a difference of 0.2 mm in diameter) is provided between the end portions 122*c*, 122*d* of the rotational shaft 122*f* and the bearing members 123*a*, 123*b* in consideration of component tolerances and environmental variations. This is to allow the sensor lever 122 to rotate smoothly without the rotational shaft 122*f* receiving excessive frictional resistance from the bearing members 123*a*, 123*b* even if there are component tolerances or environmental variations (such as differences in thermal expansion due to temperature changes).

The sheet contacting portion 122*a* extends from the rotational shaft 122*f* toward the feeding path of the sheet S. The feeding path is the space through which the sheet S fed from the separation nip passes, and is formed, for example, by a plate-like feeding guide extending along the feeding direction X. As shown in FIG. 4A, when the sheet S has not reached the sensor lever 122, the sheet contacting portion 122*a* protrudes into the feeding path.

The position of the sensor lever 122 when the sheet S is not in contact with the sensor lever 122 as shown in FIG. 4A is hereinafter referred to as the "stand-by position" of the sensor lever 122. The state of the sheet sensor portion 120 when the sensor lever 122 is in the stand-by position is defined as the stand-by state (non-detection state). When the tip of the sheet S being fed along the feeding path contacts the sheet contacting portion 122*a* from the upstream side of the feeding direction X, the sensor lever 122 moves from the stand-by position to the counterclockwise operating direction R1 (first rotational direction) as shown in FIG. 4B. This causes the sheet contacting portion 122*a* to move upward, allowing the sheet S to pass through.

The sensor light shielding portion 122*e* is disposed between the light-emitting and light-receiving portions 121*a* and 121*b* of the sensor 121 in the sheet width direction Y, and is formed to a size that enables it to block the optical axis connecting the light-emitting portion 121*a* and the light-receiving portion 121*b* when viewed in the sheet width direction Y. The sensor light shielding portion 122*e* of the present embodiment is positioned so that it does not block the sensor 121 when the sensor lever 122 is in the stand-by position, and blocks the sensor 121 when the sensor lever 122 is rotated more than a predetermined angle in the operating direction R1 from the stand-by position. As a result, the amount of light entering the light-receiving portion 121*b* changes according to the position of the sensor lever 122.

The state in which the signal of the light receiving portion 121*b* exceeds (or falls below) a predetermined threshold due to the sensor lever 122 being rotated in the operating direction R1 is the operating state (detection state) of the sheet sensor portion 120. The sensor light shielding portion 122*e* is configured to shield the sensor 121 when the sensor lever 122 is in the stand-by position, and to not shield the sensor 121 when the sensor lever 122 is rotated more than a predetermined angle from the stand-by position to the operating direction R1.

The sheet contacting portion 122*a*, for example, is long enough to penetrate the guide surface 129 through an opening in the guide surface 129 of the feed guide on the opposite side of the rotational shaft 122*f* across the feeding path, as shown in FIG. 4A. This allows the sheet fed along the feeding path to contact the sheet contacting portion 122*a* more securely.

The stopper contacting portion 122*b* extends in a direction different from that in which the sheet contacting portion 122*a* extends from the rotational shaft 122*f*. In the present embodiment, whereas the sheet contacting portion 122*a* extends from the rotational shaft 122*f* in a downward direction (toward the feeding path in the vertical direction Z), the stopper contacting portion 122*b* extends from the rotational shaft 122*f* in an upward direction (away from the feeding path in the vertical direction Z).

The return spring 124 is a torsion coil spring mounted around the rotational shaft 122*f* The arm 124*a*, one end portion of the return spring 124, is attached to the spring-hooked portion 123*c* on the supporting member 123 as shown in FIG. 3. The arm 124*b*, the other end portion of the return spring 124, is attached to the spring-hooked portion 122*g* on the sensor lever 122, as shown in FIG. 4A.

The return spring 124 urges the sensor lever 122 in the return direction R2 (second rotational direction) opposite to the operating direction R1, which is the rotational direction of the sensor lever 122 when it is in contact with the sheet S. Specifically, while one arm 124*a* of the return spring 124 is held by the supporting member 123, the other arm 124*b* presses the spring-hooked portion 122*g* of the sensor lever 122 to the right side in FIG. 4A. This causes a moment of force in the return direction R2 centered on the rotational shaft 122*f* to act on the sensor lever 122 with the spring-hooked portion 122*g* as the point of force action.

The stopper 125 is provided at a position opposite the tip portion of the stopper contacting portion 122*b* in the circumferential direction around the rotational shaft 122*f*. In the present embodiment, the stopper 125 is arranged so that it contacts the stopper contacting portion 122*b* from the downstream side of the feeding direction X when the sensor lever 122 is in the stand-by position. When the sensor lever 122 is in the stand-by position, the stopper 125 contacts the stopper contacting portion 122*b* to restrict the rotation of the sensor lever 122 in the return direction R2, thereby holding the sensor lever 122 in the stand-by position against the urging force of the return spring 124. The stopper 125 may be integrally molded as a part of the supporting member 123, or may be a member attached to the supporting member 123.

Of the sensor lever 122, the sheet contacting portion 122*a* and the stopper contacting portion 122*b* are installed near one end portion 122*c* of the rotational shaft 122*f* in the sheet width direction Y, and the sensor light shielding portion 122*e* is installed near the other end portion 122*d* of the rotational shaft 122*f* (FIG. 3). In other words, the sheet contacting portion 122*a* is located near the center of the feeding path in the sheet width direction Y, and the sensor light shielding portion 122*e* is located farther out with respect to the sheet width direction Y. This allows the sheet to contact the sensor lever 122 regardless of the size of the sheet being fed along the feeding path, and allows the sheet sensor portion 120 to detect the sheet. By moving the sensor 121 away from the sheet contacting portion 122*a*, it is possible to reduce the possibility of foreign matter such as paper dust that has come off the sheet adhering to the sensor 121, and also to shorten the wiring length of the sensor 121. However, the sheet contacting portion 122*a*, the stopper contacting portion 122*b* and the sensor light shielding portion 122*e* can be placed closer to each other, so that the sensor lever 122 has a shorter length in the sheet width direction Y.

(Direction of the Force Applied to the Sensor Lever)

FIG. 5A to FIG. 5C illustrate the relationship between the direction of the force applied to the sensor lever 122 for the present embodiment and the operation sound.

FIG. 5A illustrates the state where the sensor lever is in the stand-by position. As described above, in the stand-by state, the sensor lever is held in the stand-by position by the contacting portion of the stopper 125 and the stopper contacting portion 122*b*.

Here, the arm 124*b* on the sensor lever side of the return spring 124 exerts force f1*d* in the roughly right direction in the figure against the spring-hooked portion 122*g* of the sensor lever 122. On the other hand, the arm 124*a* on the supporting member side of the return spring 124 exerts a force f1*c* in the roughly right direction in the figure against the spring-hooked portion 123*c* of the supporting member 123 (see also FIG. 3). Therefore, the return spring 124 receives the reaction forces f1*a* and f1*b* of the forces f1*c* and f1*d* from the supporting member 123 and the spring-hooked portions 123*c* and 122*g* of the sensor lever 122. Since the coil portion of the return spring 124 is attached to the rotational shaft 122*f* of the sensor lever 122, the force F1 corresponding to the combined force of these reaction forces f1*a* and f1*b* is applied to the rotational shaft 122*f* via the coil portion.

When the fed sheet comes in contact with the sensor lever 122 in the stand-by position, the sensor lever 122 rotates in the operating direction R1 (see FIG. 4B). At this time, the urging force of the return spring 124 is charged up. When the rear end of the sheet exits the sensor lever 122, the sensor lever 122 is released from the sheet and rotates in the return direction R2 according to the urging force of the return spring 124.

FIG. 5B shows the moment when the sensor lever 122, which rotates in the return direction R2, reaches the stand-by position (hereinafter referred to as the "sensor lever return moment"). Since the sensor lever 122 is rotating vigorously by the urging force of the charged-up return spring 124, when the stopper contacting portion 122*b* contacts the stopper 125, the sensor lever 122 tries to move to the left in the figure. In other words, the entire sensor lever 122 tries to rotate in the direction that the rotational shaft 122*f* moves in the direction of the force f2 that the stopper contacting portion 122*b* receives from the stopper 125 around the contacting position of the stopper contacting portion 122*b* and the stopper 125.

This can also be expressed as follows. When the sensor lever 122 receives a force f2 from the stopper 125 and stops rotating, the inertia of the sensor lever 122 causes a moment M2 centered on the contacting portion 122*b* of the stopper with the stopper 125. The force F2 represents the force F2 when this moment M2 is considered to be caused by the virtual force F2 applied to the rotational shaft 122*f*.

FIG. 5C is a schematic view of the bearing member 123*a* of the supporting member 123 and the end portion 122*c* of the rotational shaft 122*f* of the sensor lever 122. As described above, in the stand-by state, the rotational shaft 122*f* is pushed against the bearing member 123*a* by a force F1 (the first force), which is equivalent to the combined force of the reaction forces f1*a* and f1*b* that the return spring 124 receives from the spring-hooked portions 123*c* and 122*g* of the supporting member 123 and the sensor lever 122. On the other hand, when the sensor lever returns, the rotational shaft 122*f* is pressed against the bearing member 123*a* by a force F2 (second force) equivalent to the force f2 that the sensor lever 122 receives from the stopper 125.

In the present embodiment, the direction of the force F1 that presses the rotational shaft 122*f* against the bearing member 123*a* in the stand-by state and the direction of the force F2 that presses the rotational shaft 122*f* against the bearing member 123*a* when the sensor lever returns are set to be substantially the same direction. In other words, the return spring 124 is arranged so that the direction of the first force (F1) and the second force (F2) are in substantially the same direction.

In the present embodiment, when the angle between forces F1 and F2 is set to $\alpha$ (degrees) in the state viewed in the sheet width direction Y (state shown in FIG. 5A to FIG. 5C), $\alpha=1$. This makes the position of the rotational shaft 122*f* in the stand-by state shown by the solid line in FIG. 5C and the position of the rotational shaft 122*f* (dashed line) when the sensor lever returns to the stand-by state to be substantially the same. In the present embodiment, the substantially same means $\alpha \leq 20$ as described below. In other words, the direction in which the rotational shaft 122*f* moves for removing a play against the bearing member 123*a* between the stand-by state and when the sensor lever is returned is substantially the same, and thus the fluctuation of the shaft position of the rotational shaft 122*f* is suppressed to a very small extent.

Comparison with Comparative Examples

Figure 7B:
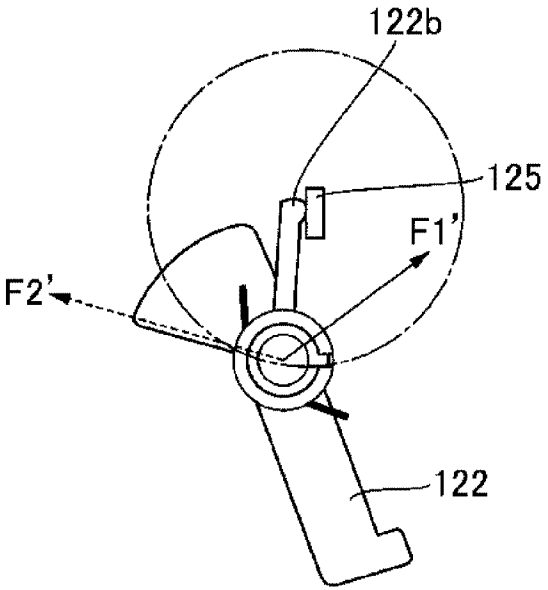
FIG. 7B is a drawing illustrating the direction of force applied to the sensor lever for the comparative example, when the sensor lever has reached the stand-by position from the operating position.
Figure 7A:
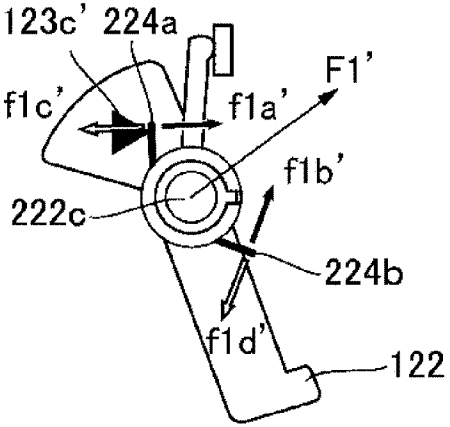
FIG. 7A is a drawing illustrating the direction of force applied to the sensor lever for a comparative example, when the sensor lever is in the stand-by position.
Figure 7C:
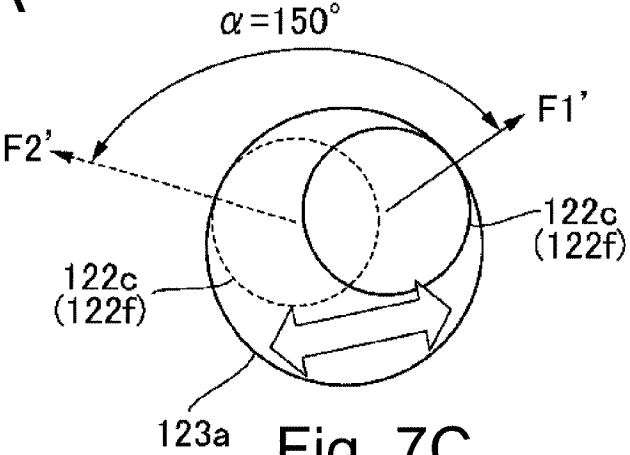
FIG. 7C is a drawing illustrating the direction of force applied to the sensor lever for the comparative example, especially around the rotational shaft of the sensor lever.

As a comparative example to the present embodiment, the case where the configuration shown in FIG. 7A to FIG. 7C is used will be explained. This comparative example has a common configuration with Embodiment 1, except that the relationship between the directions of the forces F1 and F2 applied to the rotational shaft 122*f* of the sensor lever 122 in the stand-by state and when the sensor lever returns differ from Embodiment 1 due to the different arrangement of the return spring 124.

As shown in FIG. 7A, a torsion coil spring is also used as the return spring 224 in this comparative example. However, the arm portion 224*b* on the sensor lever side of the return spring 224 applies a roughly downward force f1*d*' in the figure to the spring load portion 122*g*' of the sensor lever 122 to urge the sensor lever 122 in the return direction R2. In addition, the arm portion 224*a* on the supporting member side of the return spring 224 applies a force f1*c*' toward the left in the figure against the spring-hooked portion 123*c*' of the supporting member 123. Therefore, in the stand-by state, the reaction forces f1*a*' and f1*b*' of the forces f1*c*' and f1*d*' act on the return spring 224, and the reaction forces f1*a*' and f1*b*' act on the rotational shaft 122*f*. The direction of this force F1' is toward the downstream side with respect to the feeding direction X, which is different from the direction of the force F1 in Embodiment 1 (FIG. 5A and FIG. 5C).

On the other hand, as shown in FIG. 7B, the positional relationship between the sensor lever 122 and the stopper 125 is the same as that of Embodiment 1, so in this comparative example, the direction of the force F2 's direction is substantially the same as that of Embodiment 1.

As shown in FIG. 7A, in the case of this comparative example, the angle cc between the force F1' that presses the rotating shaft 222*c* against the bearing member 123*a* in the stand-by state, and the force F2' that presses the rotating shaft 222*c* against the bearing member 123*a* when the sensor lever returns is 150 degrees. In this case, the direction in which the rotational shaft 122*f* moves for removing the play against the bearing member 123*a* differs greatly between the stand-by state and the sensor lever return state, and the positional fluctuation of the rotational shaft 122*f* becomes large. As a result, the amplitude of the vibration of the sensor lever 122 caused by the play between the bearing member 123*a* and the rotational shaft 122*f* becomes larger, causing the operation noise of the sensor lever 122 to become louder.

On the other hand, in the configuration of the present embodiment shown in FIGS. 5A through 5C, the direction in which the rotational shaft 122*f* moves for removing the play against the bearing member 123*a* is substantially the same between the stand-by state and the sensor lever return state, as described above. Therefore, the fluctuation of the shaft position of the rotational shaft 122*f* is minimized. As a result, the amplitude of vibration when the sensor lever 122 returns to the stand-by position is reduced, and the operation noise of the sensor lever 122 can be reduced.

Figure 6:
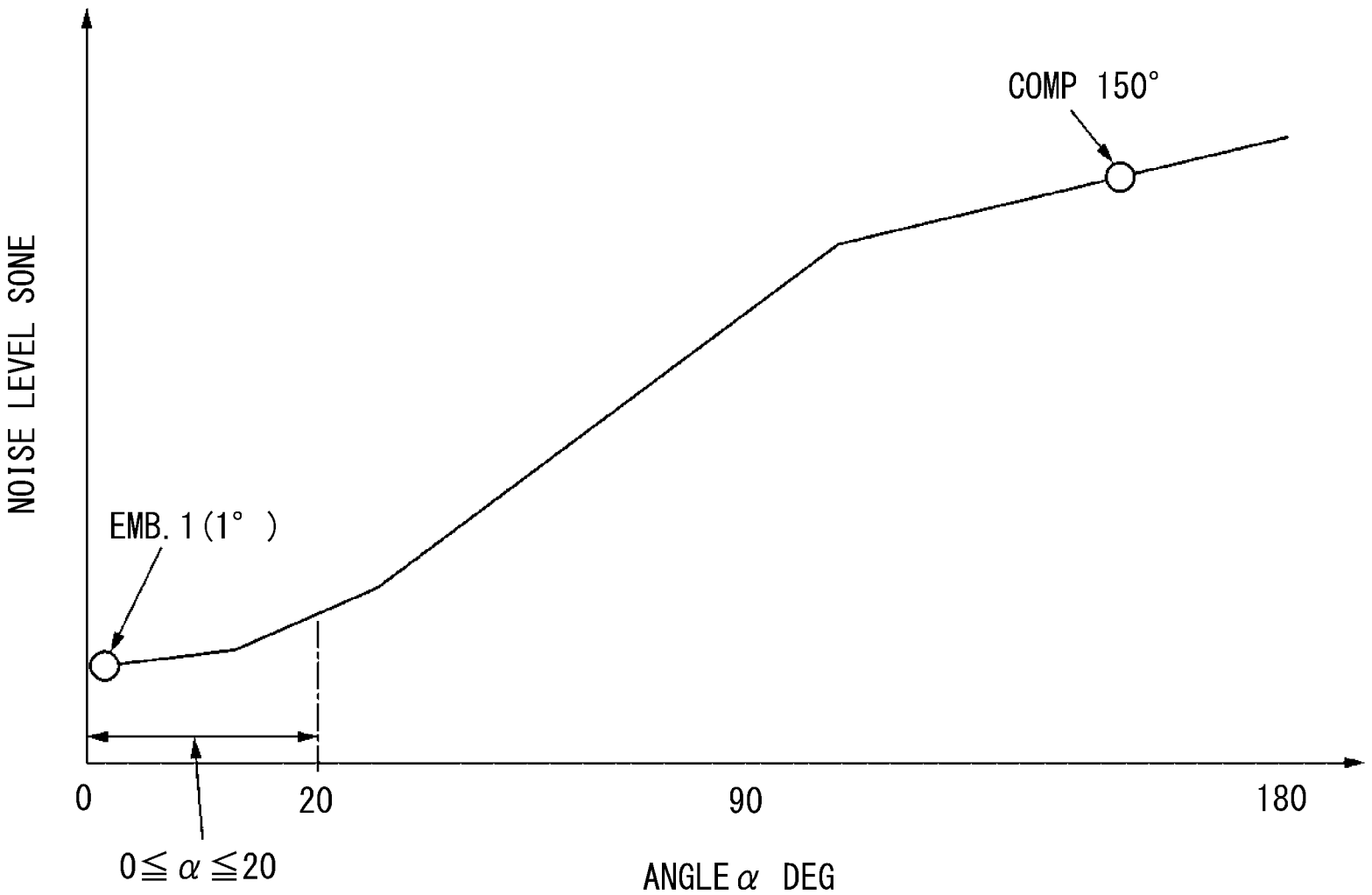
FIG. 6 is a graph showing the relationship between the angle between the direction of force received from the return spring and the direction of force received from the stopper during return and the noise level of the sensor lever return sound.

By the way, FIG. 6 shows the relationship between the angle α between force F1 and force F2 and the noise level. As can be seen from the graph, there is a correlation that the larger the angle α becomes, the larger the noise level becomes. Therefore, if the angle α is set to a predetermined angle or less (e.g., 20 degrees or less, more preferably 10 degrees or less), the operation noise of the sensor lever 122 can be effectively reduced.

Embodiment 2

Figure 8:
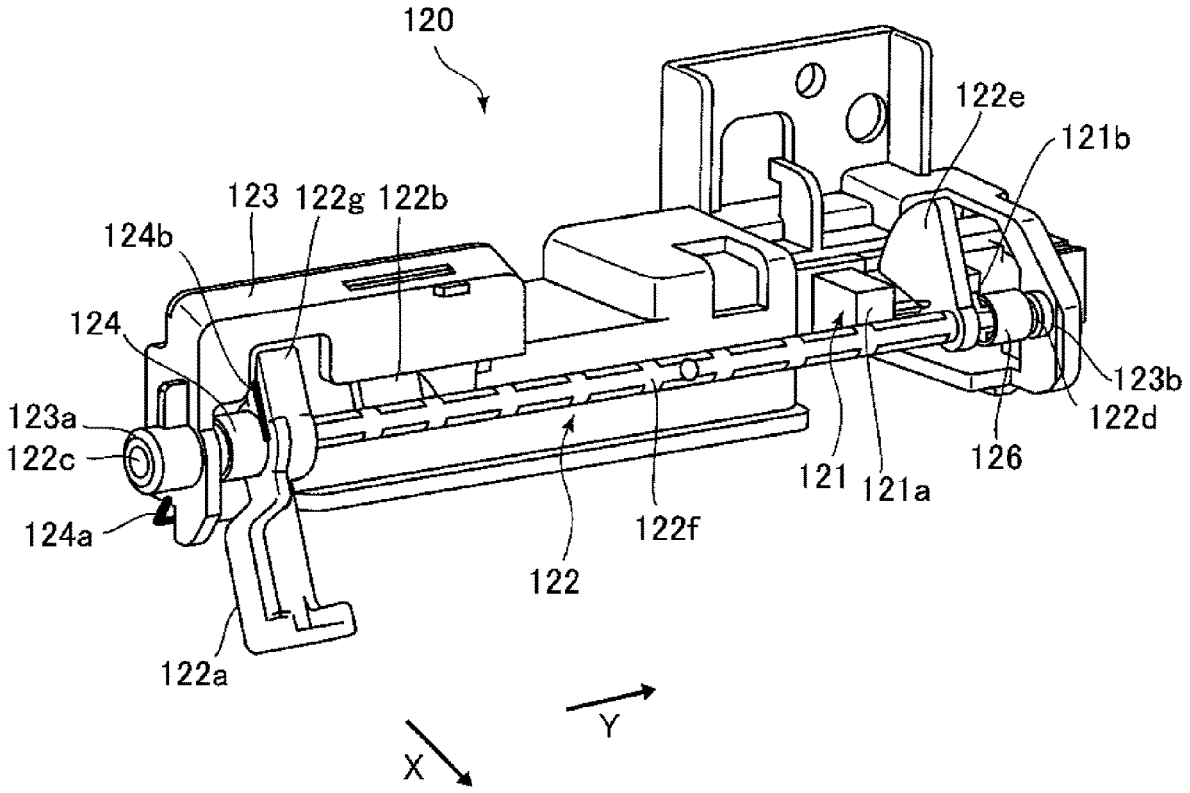
FIG. 8 is a perspective view of the sheet sensor portion for Embodiment 2.

Embodiment 2 is a configuration example in which a plurality of urging members are arranged to urge the sensor lever 122 in the return direction R2. FIG. 8 is a view of the sheet sensor portion 120 of the present embodiment (a figure corresponding to FIG. 3). In the following, elements that have substantially the same configuration and function as Embodiment 1 are denoted with the same sign as Embodiment 1 and are not explained.

As in Embodiment 1, the rotational shaft 122*f* of the sensor lever 122 is a member extending in the sheet width direction Y, and the return spring 124 as the first urging member is attached to one end portion 122*c* of the rotational shaft 122*f*. In this configuration, vibration of the sensor lever 122 may occur due to the play between the end portion 122*d* opposite to the return spring 124 and the bearing member 123*b* of the supporting member 123. For example, if the torsional stiffness of the sensor lever 122 made of synthetic resin is not sufficiently high, or if the rotational shaft 122*f* is very long, the urging force of the return spring 124 may not be sufficiently transmitted to the opposite end portion 122*d* of the rotational shaft 122*f*.

Therefore, in the present embodiment, a return spring 126 as a second urging member is also attached to the opposite end portion 122*d*. The return spring 126 is a torsion coil spring mounted around the rotational shaft 122*f*, with one end portion (arm) supported by the supporting member 123 and the other end portion (arm) attached to the sensor lever 122, thereby pushing the sensor lever 122 in the return direction R2. With the addition of the return spring 126, the end portion 122*d* of the rotational shaft 122*f* can be moved for removing the play against the bearing member 123*b* to further reduce the operation noise of the sensor lever 122.

In the present embodiment, the added return spring 126 is used as a supplementary spring, and the urging force of the return spring 126 (urging force in the R2 direction) is set to be smaller than the urging force of the return spring 124, specifically 20-30% of the urging force of the return spring 124. When making a difference in the urging force of the return springs 124 and 126, it is suitable to increase the urging force of the return spring 124 on the same side as the seat contacting portion 122*a* (first contacting portion) and the stopper contacting portion 122*b* (second contacting portion). This can effectively reduce the operation noise of the sensor lever 122.

Also in the present embodiment, the return springs 124 and 126 are arranged so that the direction of the force F1 that presses the rotational shaft 122*f* against the bearing member 123*a* in the stand-by state and the direction of the force F2 that presses the rotational shaft 122*f* against the bearing member 123*a* when the sensor lever returns are substantially the same direction. For example, it is suitable to set the angle α between the force with which the added return spring 126 presses the end portion 122*d* of the rotational shaft 122*f* to the bearing member 123*b* in the standby state and the force F2 to 20 degrees.

Other Embodiments

In the above-described embodiments, an example of a configuration in which a sheet sensor portion 120 as a sheet detecting device is arranged in a sheet feeding apparatus is described, but the sheet detecting device of the present disclosure may be applied to other parts where sheets are fed. For example, it may be used as a sheet detecting device that detects sheets to be ejected in the ejecting portion that ejects sheets from the image forming apparatus. It may also be used as a sheet detecting device that detects the sheet being fed in an image reading device equipped with an automatic document feeder that feeds the sheet as a document, not limited to an image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-154855 filed on Sep. 15, 2020, which hereby incorporated by reference herein in its entirety.

What is claimed is:

1. A sheet detecting device comprising:

a rotatable member including a rotational shaft, positioned in a stand-by position in a state of being in non-contact with a sheet, and configured to rotate about said rotational shaft from the stand-by position in a first rotational direction by being contacted with the sheet when the sheet is fed;

a detecting portion configured to detect a rotation of said rotatable member;

a supporting member configured to rotatably support said rotational shaft;

a first torsion coil spring configured to urge so as to rotate said rotatable member in a second rotational direction opposite to the first rotational direction and disposed on one edge side of said rotational shaft with respect to a rotational axis direction of said rotatable member;

a second torsion coil spring configured to urge so as to rotate said rotatable member in the second rotational direction and disposed on another edge side of said rotational shaft with respect to the rotational axis direction of said rotatable member; and a restricting member disposed on one edge side of said rotational shaft and configured to restrict rotation in the second rotational direction of said rotatable member which is positioned in the stand-by position and which is urged by said first torsion coil spring and said second torsion coil spring, wherein a direction of a first force acting on said rotational shaft by said first torsion coil spring and a direction of a second force acting on said rotational shaft by said second torsion coil spring, in a case in which said rotatable member is positioned in the stand-by position, are substantially a same direction as a direction of a third force which said rotatable member receives from said restricting member when said rotatable member is in contact with said restricting member, and wherein in a case in which said rotatable member is positioned in the stand-by position, the first force acting on said rotational shaft by said first torsion coil spring is larger than the second force acting on said rotational shaft by said second torsion coil spring.

2. A sheet detecting device according to claim 1, wherein said supporting member includes (a) a first bearing member configured to support one end portion of said rotational shaft and disposed on a center position side in a feeding path with respect to the rotational axis direction of said rotatable member, and (b) a second bearing member configured to support the other end portion of said rotational shaft and disposed outside of the feeding path with respect to the rotational axis direction of said rotatable member.

3. A sheet detecting device according to claim 1, wherein said rotatable member includes (a) a first contacting portion to be contacted with the sheet and (b) a second contacting portion contacting with said restricting member, wherein said first contacting portion and said second contacting portion are disposed on one edge side of said rotational shaft.

4. A sheet detecting device according to claim 3, wherein said first torsion coil spring is attached around said rotational shaft, wherein one end portion of said first torsion coil spring is attached to said supporting member, and wherein the other end portion of said first torsion coil spring is attached to said first contacting portion, and wherein said second torsion coil spring is attached around said rotational shaft, wherein one end portion of said second torsion coil spring is attached to said supporting member, and wherein the other end portion of said second torsion coil spring is attached to said second contacting portion.

5. A sheet detecting device according to claim 4, wherein as viewed in the rotational axis direction of said rotatable member in a state in which said rotatable member is positioned in the stand-by position, said restricting member and said one end portion of said first torsion coil spring are provided on a side opposite to a feeding path for feeding the sheet across the rotational axis of said rotational shaft, and said the other end portion of said first torsion coil spring is provided on the same side of the feeding path with respect to the rotational axis of said rotational shaft, and wherein said one end portion of said first torsion coil spring urges said rotatable member toward a downstream side with respect to a feeding direction of the sheet.

6. A sheet detecting device according to claim 1, wherein said detecting portion includes an optical sensor shielded by a light shielding portion provided on said rotatable member.

7. An image forming apparatus comprising:

a sheet detecting device according to claim 1; and an image forming portion configured to form an image on a sheet.

8. A sheet detecting device according to claim 1, wherein the first force is a combined force applied to said rotational shaft via a coil portion of said first torsion coil spring, wherein said combined force consists of a first A force and a first B force, and wherein the first A force is a force applied from said support member and the first B force is a force applied from said rotatable member.

9. A sheet detecting device comprising:

a rotatable member including a rotational shaft, positioned in a stand-by position in a state of being in non-contact with a sheet, and configured to rotate about said rotational shaft from the stand-by position in a first rotational direction by being contacted with the sheet when the sheet is fed;

a detecting portion configured to detect a rotation of said rotatable member;

a supporting member configured to rotatably support said rotational shaft;

a first torsion coil spring configured to urge so as to rotate said rotatable member in a second rotational direction opposite to the first rotational direction and disposed on one edge side of said rotational shaft with respect to a rotational axis direction of said rotatable member;

a second torsion coil spring configured to urge so as to rotate said rotatable member in a second rotational direction and disposed in on another edge side of said rotational shaft with respect to the rotational axis direction of said rotatable member; and a restricting member disposed on one edge side of said rotational shaft and configured to restrict rotation in the second rotational direction of said rotatable member which is positioned in the stand-by position and which is urged by said first torsion coil spring and said second torsion coil spring, wherein as viewed in the rotational axis direction of said rotatable member, an angle between a direction of a first force acting on said rotational shaft by said first torsion coil spring in a case in which said rotatable member is positioned in the stand-by position and a direction of a third force which said rotatable member receives from said restricting member when said rotatable member is in contact with said restricting member is 20 degrees or less, wherein as viewed in the rotational axis direction of said rotatable member, an angle between a direction of a second force acting on said rotational shaft by said second torsion coil spring in a case in which said rotatable member is positioned in the stand-by position and the direction of the third force is 20 degrees or less, and wherein in a case in which said rotatable member is positioned in the stand-by position, the first force acting on said rotational shaft by said first torsion coil spring is larger than the second force acting on said rotational shaft by said second torsion coil spring.

10. A sheet detecting device according to claim 9, wherein as viewed in the rotational axis direction of said rotatable member, (a) the angle between the direction of the first force and the direction of the third force is 10 degrees or less, and (b) the angle between the direction of the second force and the direction of the third force is 10 degrees or less.

* * * * *